US005882183A

United States Patent [19]

Andres

[11] Patent Number: 5,882,183

[45] Date of Patent: Mar. 16, 1999

[54] SELF-ALIGNING ROTARY VANE

[75] Inventor: David Christopher Andres, Berkeley, Calif.

[73] Assignee: Triple Aught, LLC, Berkeley, Calif.

[21] Appl. No.: 822,217

[22] Filed: Mar. 21, 1997

[51] Int. Cl.[6] ..... F01C 1/344; F01C 19/00

[52] U.S. Cl. ..... 418/92; 418/147; 418/152

[58] Field of Search ..... 123/243; 418/92, 418/147, 148, 152

[56] References Cited

U.S. PATENT DOCUMENTS

| | | | |
|---|---|---|---|
| 1,922,363 | 8/1933 | Hapkins | 123/243 |
| 2,179,401 | 11/1939 | Chkliar | 123/231 |
| 2,827,025 | 3/1958 | Puim | 123/231 |
| 3,103,920 | 9/1963 | Georges | 418/92 |
| 3,412,686 | 11/1968 | Eickmann . | |
| 3,452,725 | 7/1969 | Kelly | 418/152 |
| 3,514,232 | 5/1970 | Mitchell et al. | 418/27 |
| 3,782,107 | 1/1974 | Bendall | 60/39.61 |
| 3,854,842 | 12/1974 | Caudill | 415/116 |
| 3,866,908 | 2/1975 | Ruzic . | |
| 3,872,840 | 3/1975 | Adragna . | |
| 3,873,253 | 3/1975 | Eickmann | 418/147 |
| 3,902,465 | 9/1975 | Stookey . | |
| 3,909,013 | 9/1975 | Kumar | 277/25 |
| 3,951,112 | 4/1976 | Hunter . | |
| 4,548,560 | 10/1985 | Kanao | 418/144 |
| 4,672,813 | 6/1987 | David | 418/92 |
| 5,072,705 | 12/1991 | Overman | 123/231 |
| 5,092,752 | 3/1992 | Hansen | 418/137 |
| 5,161,962 | 11/1992 | Comerci | 418/147 |
| 5,571,244 | 11/1996 | Andres | 123/231 |

FOREIGN PATENT DOCUMENTS

| | | | |
|---|---|---|---|
| 57-76206 | 5/1982 | Japan | 418/147 |
| 1599581 | 10/1990 | U.S.S.R. . | |
| 2218469 | 11/1989 | United Kingdom . | |

*Primary Examiner*—Michael Koczo
*Attorney, Agent, or Firm*—Francis L. Conte

[57] ABSTRACT

A rotary machine vane includes a body and an articulated tip pivotally joined thereto. The body is complementary with a slot of a rotor in which it is mountable for radial reciprocation therein. The body includes an arcuate cradle extending axially along a radially outer end thereof. The vane tip includes a pin and an integral plate extending along the pin for facing a casing surrounding the rotor to form a seal therewith. The pin is complementary to the cradle for defining a radial gap therebetween, and is radially outwardly retained by the cradle for rocking movement therein for self-alignment with the casing.

22 Claims, 6 Drawing Sheets

SELF-ALIGNING ROTARY VANE

BACKGROUND OF THE INVENTION

The present invention relates generally to rotary machines, and, more specifically, to a rotary compressor, pump, or engine.

In one type of rotary machine, a rotor is mounted for rotation inside an oblong stator casing. The rotor includes a plurality of circumferentially spaced apart perimeter slots from which extend radially outwardly a respective plurality of vanes. Each of the vanes has a radially outer tip which slides along the casing as the rotor rotates during operation, with the oblong casing causing the vane to reciprocate radially in and out of the rotor slots as the rotor rotates.

The oblong casing defines with the perimeter of the rotor two generally crescent working chambers through which the reciprocating vanes travel. In one chamber, a working fluid such as air is compressed by the rotating vanes. Both working chambers may be similarly configured for air compression and therefore may define a rotary compressor. Or, fuel may be injected into the compressed air and suitably ignited for undergoing expansion in the second chamber for defining an internal combustion rotary engine. In both examples, the vanes either impart energy into the fluid being compressed, or extract energy from the expanding combustion gases, with associated forces being carried through the rotor and cooperating drive shaft.

Rotation of the rotor during operation generates significant centrifugal force on the individual vanes which is reacted by the cooperating casing. The vane tips must therefore be suitably lubricated for decreasing undesirable frictional wear between the vane tips and the casing. In order to reduce the centrifugal forces on the vane tips, the vanes are preferably made as light as possible, yet must also be sufficiently strong for accommodating the reaction forces of compressing the fluid or expanding the gas with a suitable useful life.

An exemplary rotary engine is disclosed in U.S. Pat. No. 5,571,244-Andres which includes lightweight ceramic vanes having an air bearing and seal at the vane tips. Pressurized air is channeled through the vanes and tips from which it is discharged to form a thin air blanket between the vane tips and the cooperating casing. The air blanket provides a low friction air bearing for reacting the centrifugal forces generated in the vanes, and also provides an effective fluid seal for separating the working fluid on both sides of the vane.

The oblong casing disclosed in this patent includes two semi-circular arcuate portions and two flat portions disposed therebetween. The traveling vane tips must therefore transition between the arcuate and flat portions of the casing. At the center of the flat portion and along the arcuate portions of the casing, the vanes travel perpendicular thereto. However, on both off-center sides of the flat portions, the vanes are necessarily non-perpendicular thereto at relatively small tilt angles. The non-perpendicular alignment of the vanes relative to the off-center portions of the flat casing increases the difficulty of establishing an effective air bearing and seal between the vane tips and the casing.

The Andres patent identified above discloses two tip arrangements for providing effective vane tip seals and bearings. However, these arrangements are geometrically fixed in relationship to the vanes, and necessarily change angular orientation relative to the casing at the off-center flat portions thereof. The bearing gap between the vane tips and the casing therefore becomes nonuniform at the off-center flat portions which decreases the effectiveness of the air bearing and seal at the vane tips.

Accordingly, it is desired to provide an improved vane for a rotary machine having a self-aligning, lubricated vane tip.

SUMMARY OF THE INVENTION

A rotary machine vane includes a body and an articulated tip pivotally joined thereto. The body is complementary with a slot of a rotor in which it is mountable for radial reciprocation therein. The body includes an arcuate cradle extending axially along a radially outer end thereof. The vane tip includes a pin and an integral plate extending along the pin for facing a casing surrounding the rotor to form a seal therewith. The pin is complementary to the cradle for defining a radial gap therebetween, and is radially outwardly retained by the cradle for rocking movement therein for self-alignment with the casing.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DESCRIPTION OF THE PREFERRED EMBODIMENT(S)

Figure 1:
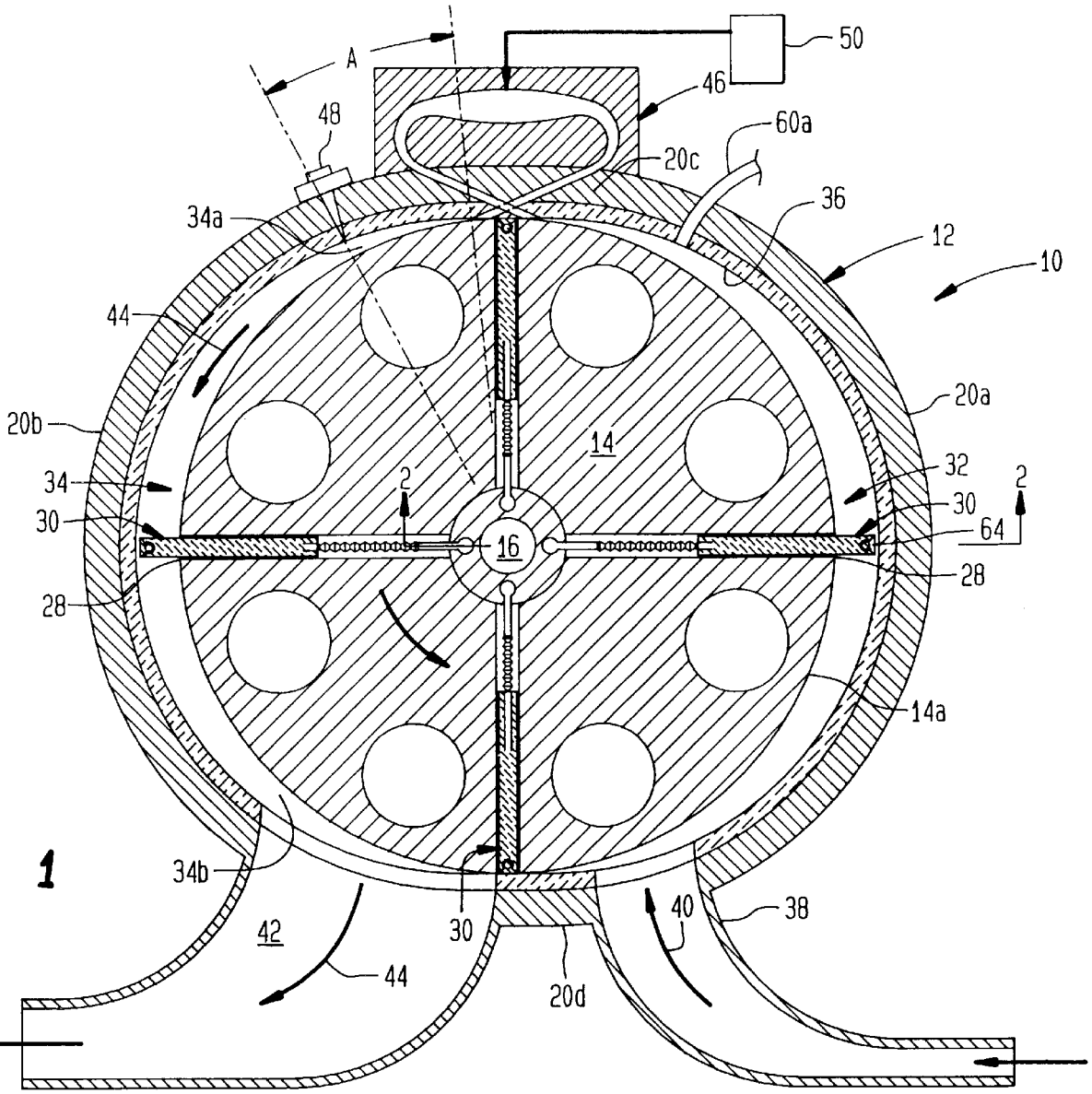
FIG. 1 is a radial sectional view through an exemplary rotary machine having a rotor mounted in an oblong casing, with a plurality of self-aligning vanes disposed in the rotor in accordance with an exemplary embodiment of the present invention.
Figure 2:
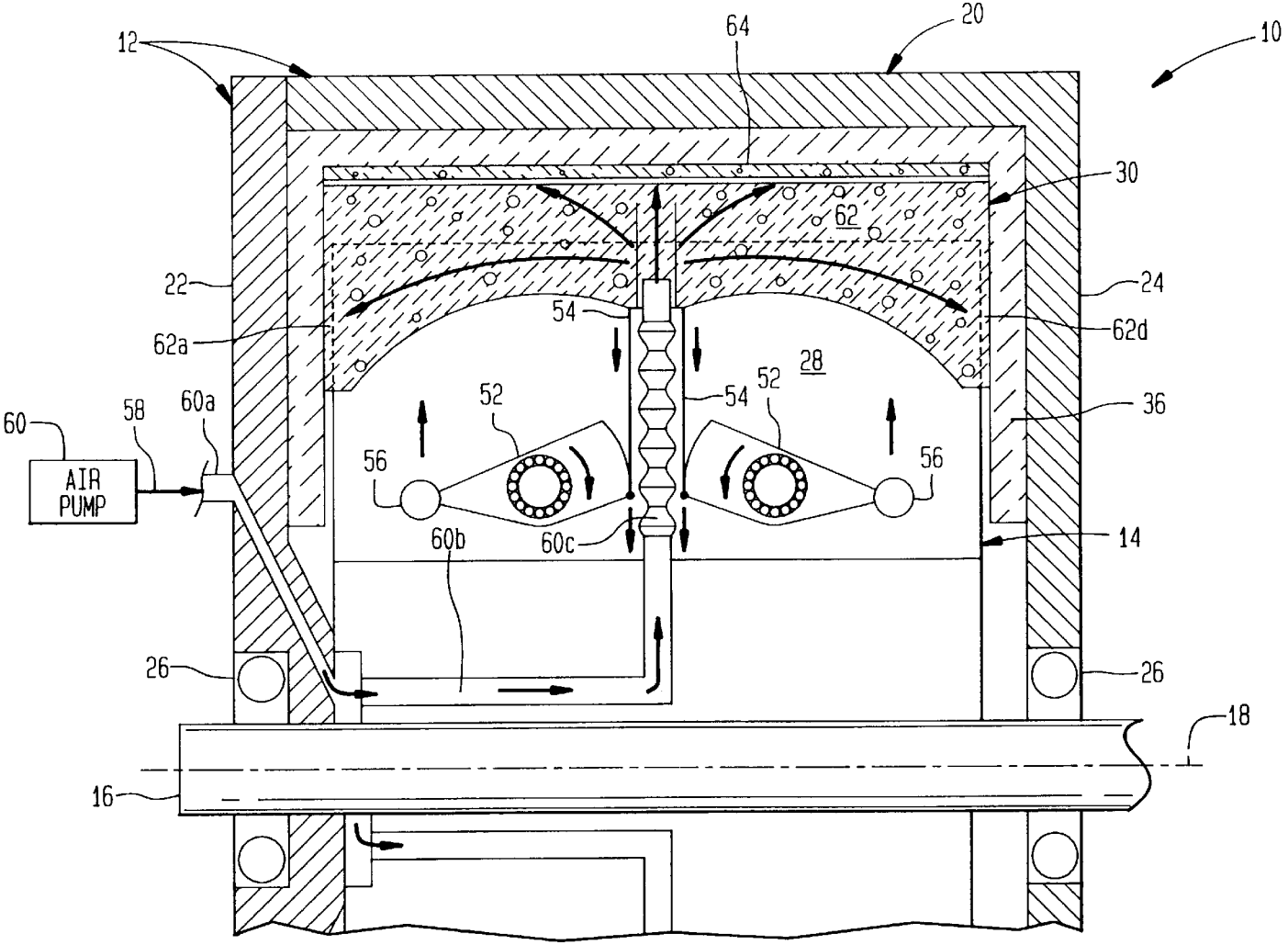
FIG. 2 is an axial sectional view through an exemplary one of the rotor vanes illustrated in FIG. 1 and taken generally along line 2—2.

Illustrated schematically in FIGS. 1 and 2 is an exemplary rotary machine 10 in accordance with one embodiment of the invention. The machine 10 is configured as an internal combustion engine, but may also be configured as a rotary pump or compressor. The machine 10 includes a stationary stator housing 12 in which is disposed a cylindrical rotor 14. A drive shaft 16 is fixedly joined to the rotor 14 coaxially along an axial centerline axis 18. The drive shaft 16 defines an output power shaft for the engine embodiment illustrated; but would define an input power shaft externally driven by a motor in the pump or compressor embodiments of the invention.

The stator housing 12 includes an annular perimeter wall or casing 20, and first and second annular sidewalls 22 and 24 integrally joined thereto. The stator housing 12 is preferably formed of two parts, with the first sidewall 22 being one part, and the second sidewall 24 and casing 20 being the second part, both suitably joined together.

The rotor 14 is disposed in the housing 12 between the first and second sidewalls 22, 24, with the drive shaft 16 being suitably fixedly joined to the center of the rotor 14 and being coaxially rotatably mounted to the first and second sidewalls 22, 24 by suitable sealed roller or ball bearings 26. The rotor 14 is preferably formed of a suitable lightweight material such as titanium or aluminum, and may have suitable holes therein as shown in FIG. 1 for reducing unnecessary weight thereof. The housing 12 is preferably a heat conductive structure such as aluminum.

As shown in FIG. 1, the rotor 14 preferably has four slots 28 extending radially inwardly from a circular perimeter 14*a* thereof, and are equiangularly spaced apart from each other at 90°. Four planar vanes 30 are slidably mounted in respective ones of the rotor slots 28 as disclosed in more detail hereinbelow. The vanes 30 are preferably made of glassy carbon foam converted to a silicon carbide, ceramic, foam commercially available from Destech Corp, of Tucson, Ariz. This conversion from a ceramic carbon to a ceramic silicon carbide provides anti-oxidation performance to increase the useful life of the vanes in the combustion engine embodiment of the invention. The interior of the vanes 30 is preferably porous with an open cell structure of about 80–100 pores per inch, for example, with the exterior of the vanes 30 being an integral non-porous solid ceramic shell, preferably including a ceramic matrix reinforced with ceramic fibers such as carbon or silicon carbide, for example.

As shown in FIG. 1, the perimeter casing 20 is preferably oblong in transverse configuration and includes first and second, diametrically opposite arcuate portions 20*a* and 20*b*, and first and second diametrically opposite flat portions 20*c* and 20*d* disposed therebetween. The arcuate portions 20*a,b* are preferably portions of a circle each having the same, single radius which is preferably equal to the radius of the rotor perimeter 14*a*. The arcuate portions 20*a,b* are spaced radially further from the rotor perimeter 14*a* than the flat portions 20*c,d* to define generally crescent shaped, diametrically opposite first and second working chambers 32 and 34 in which the rotor vanes 30 travel.

Although the housing 12 may be formed of a suitable material for cooperating directly with the vanes 30, it preferably includes a suitable integral liner 36 which matches the inner contour of the casing 20 and sidewalls 22,24 for cooperating with the vanes 30. The liner 36 is preferably made of a suitable ceramic such as silicon carbide for cooperating with the vanes 30, which are also preferably ceramic. The ceramic liner 36 also provides heat insulation for improving efficiency of the machine, as well as improving wear resistance with the vanes 30.

When the vanes 30 are at 12 and 6 o'clock positions, they are radially retracted to the perimeter of the rotor and form a relatively tight seal with little clearance with the liner 36 disposed along the inner surface of the casing 20. The vanes 30 at the 3 and 9 o'clock positions have their maximum radial extension from the rotor 14 and are also disposed in tight sealing relationship with the liner 36. The casing 20 is symmetrically oblong, with the cylindrical rotor 14 being disposed coaxially and symmetrically therein so that during rotation of the rotor 14 in operation, radial extensions of circumferentially opposite vanes 30 are substantially equal to each other for providing inherent balancing.

Referring again to FIG. 1, an inlet port 38 is disposed through the casing 20 adjacent to an upstream end of the first chamber 32 at the casing second flat portion 20*d* for receiving a compressible fluid 40 for being compressed in the first chamber 32 as the rotor 14 rotates in the casing 20 during operation. An exhaust port 42 is disposed through the casing 20 adjacent a downstream end of the second working chamber 34 at the casing second flat portion 20*d* for discharging combustion gases 44 therefrom.

As shown in FIG. 1, the rotor 14 rotates counterclockwise, and the terms upstream and downstream as used herein refer to the general flowpath of fluid flow from the inlet port 38 at the bottom of the first chamber 32 which flows counterclockwise therearound and into the top of the second chamber 34 and again counterclockwise therethrough for discharge from the outlet port 42.

A stationary flow chamber 46 is fixedly joined to the casing 20 symmetrically at the first flat portion 20*c* thereof, which is at the 12 o'clock position on the casing 20. The flow chamber 46 is relatively simple in structure and is effective for regulating flow between the first and second chambers 32,34 in the manner disclosed in U.S. Pat. No. 5,571,244.

As shown in FIG. 1, at least one, and preferably three conventional spark plugs 48 are disposed in the casing 20 adjacent to the upstream end of the second working chamber 34 and downstream from the flow chamber 46, and are predeterminedly angularly spaced from the flow chamber outlet passage at an acute angle A for defining a combustion zone 34*a* at the upstream end of the second working chamber 34 in which combustion is initiated by ignition from the spark plugs 48. The spark plugs 48 are preferably continuous duty, and therefore require no timing apparatus.

During operation, a compressible fluid 40 such as air is channeled into the casing 20 through the inlet port 38 and may either be at ambient air pressure, or may be initially compressed by a supercharger (not shown). Also in the preferred embodiment illustrated schematically in FIG. 1, conventional fuel injecting means 50, such as one or more fuel injectors, are provided for injecting fuel into the compressible air 40 at a suitable location. Preferably, the fuel injectors 50 are joined in flow communication with the flow chamber 46 for injecting fuel into the compressed air 40 being channeled therethrough.

A combustible fuel and air mixture is discharged into the second chamber 34 from the flow chamber 46 for ignition in the combustion zone 34*a* by the spark plugs 48. Although the fuel may be gasoline, in the preferred embodiment the fuel is gaseous such as natural gas, propane, butane or hydrogen so that switching from one fuel to another will only require mixture adjustments between the fuel and the compressible air 40.

By injecting the fuel into the flow chamber 46, the air in the first working chamber 32 remains fuel-free as it is compressed. The possibility of crossignition between the combustion zone of the second chamber 34 and the first chamber 32 along the casing first flat side 20*c* is thereby eliminated. And, more accurate fuel/air metering may be obtained.

As the rotor 14 rotates counterclockwise during operation as shown in FIG. 1, the fuel-free compressible fluid 40 is drawn into the first working chamber 32 and is then compressed therein as the vanes 30 rotate counterclockwise and as the volume of the first chamber 32 progressively decreases toward the 12 o'clock position. Since the clearances between both the vanes 30 and rotor perimeter 14*a* relative to the casing liner 36 at the 12 o'clock position are relatively small for ensuring that the first and second working chambers 32, 34 are separate and distinct and substantially closed volumes, the compressed fluid is temporarily bypassed from inside the casing 20 into the flow chamber 46 wherein it is temporarily stored, mixed with fuel, and rerouted into the second working chamber 34 just prior to the combustion cycle.

Since the constantly energized spark plugs 48 begin combustion within the combustion zone 34*a*, the angular location A between the flow chamber outlet passage and the spark plugs 48 determines the volume of fluid which undergoes combustion and thereby increases substantially in pressure for driving the vanes 30, and in turn the rotor 14 counterclockwise. As the combustion gases 44 flow counterclockwise in the second chamber 34 they expand due to the progressively increasing volume of the second chamber 34 for extracting maximum energy therefrom. The exhaust port 42 is preferably located at the downstream end of the expansion cycle within the second working chamber 34 and defines an exhaust zone 34*b* from which the combustion gases 44 exit the casing 20 through the exhaust port 42.

Illustrated in FIG. 2 are exemplary means disposed in the rotor 14 for counterbalancing centrifugal force on the vanes 30 during rotation of the rotor 14. Since the vanes 30 are merely slidably disposed in the rotor slots 28, they are allowed to freely slide radially inwardly and outwardly therein in radial reciprocation for following the contour of the casing 20 as the rotor 14 rotates therein. The rotor slots 28 preferably extend axially completely through the rotor 14 to near the first and second sidewalls 22, 24 of the housing 12.

Accordingly, as the rotor 14 rotates during operation, centrifugal force urges the vanes 30 radially outwardly toward the corresponding surfaces of the liner 36 inside the casing 20 and axially between the first and second sidewalls 22, 24. Circumferentially adjacent vanes 30, the casing 20, and the rotor perimeter 14*a* together define a substantially closed volume which rotates and changes size as the vanes 30 slide in and out of their slots 28.

Since centrifugal force on the vanes 30 can have substantial magnitude especially when operating the rotor 14 at relatively high speeds, the counterbalancing means illustrated in FIG. 2 provide a radially inwardly directed force on the vanes 30 opposite to the direction of centrifugal force. More specifically, counterbalancing is provided for each of the vanes 30 by a beam or link 52 having opposite first and second ends, and an intermediate section pivotally joined to the rotor 14 by a suitable roller bearing disposed in a respective one of the rotor slots 28. The link first end is preferably joined to an inner end of the vane 30 by a flexible strap 54 which may be a suitable metal such as stainless steel or a suitable composite including Kevlar brand structural fiber. The strap 54 is fixedly joined at opposite ends thereof to the inner end of the vane 30 and the link first end. A suitably sized counterweight 56 is fixedly joined to the link second end and has a suitable mass preselected to counterbalance centrifugal force on the vanes 30.

In the preferred embodiment illustrated in FIG. 2, the counterbalancing means comprise respective pairs of the links 52, straps 54, and counterweights 56 joined to each of the vanes 30, with each of the counterweights 56 providing half of the counterbalancing force. As the rotor 14 rotates during operation, and the vanes 30 slide radially outwardly and inwardly in the respective slots 28, the counterweight 56 provides centrifugal force which tends to pull radially inwardly the vanes 30 through the straps 54, with the straps 54 translating radially while the links 52 oscillate about the link center bearing as the vanes 30 reciprocate up and down.

In order to eliminate the need for liquid or oil lubrication between the vanes 30 and the liner 36, it is desirable to provide an air bearing therebetween for preventing contact there between during operation while maintaining effective sealing thereat. More specifically, and referring to FIG. 2, the interior of the vanes 30 is preferably porous with an open cell structure, and suitable apertures extend through the solid exterior shell. The vanes 30 are suitably provided with a pressurized fluid 58, such as air and designated vane air or fluid 58, through the interiors thereof which flows out the shell for providing fluid bearings and seals between the vane 30 and the liner 36 of the housing 12. Means in the exemplary form of a suitable air pump 60 may be used for supplying the vane air 58 to the vanes 30 through a supply conduit 60*a*. The air pump 60 may be conventionally driven by the drive shaft 16, or any other suitable power source.

Alternatively, the supply conduit 60*a* may be directly joined in flow communication with the first working chamber 32 as illustrated in FIG. 1 for bleeding a portion of the working fluid 40 therefrom to supply the vane fluid 58. The separate air pump 60 is therefore not required in this self-supplying embodiment. The bleed air may be obtained from the first chamber 32 at any suitable pressure by selecting the circumferential location of the bleed port provided through the casing 20. The same fluid may therefore be used for both the working fluid 40 and the vane fluid 58, which further simplifies the machine. If desired, a storage tank (not shown) may be also used for temporarily storing the vane fluid 58 under pressure for initial supply to the vanes 30 during machine start-up.

As shown in FIG. 2, the supply conduit 60*a* extends through the housing first sidewall 22 adjacent to the drive shaft 16 and discharges the vane air 58 in a suitable cavity at the hub of the rotor 14. A suitable delivery conduit 60*b* extends through the rotor 14 from adjacent the supply conduit 60*a* from which it receives the vane air 58, which is carried through the conduit 60*b* radially upwardly to a suitable flexible bellows 60*c* and into the vane 30. The vane air 58 flows radially upwardly through the vane 30 and is discharged through the shell thereof for creating the air bearings and seals in cooperation with the liner 36 of the casing 20.

Since the vanes are not normal or perpendicular to the liner 36 in the short off-center transition regions between the 12 and 6 o'clock center sections of the casing first and second flat portions 20*c* and 20*d* to the juncture of the first and second arcuate portions 20*a* and 20*b* (see FIG. 1), the present invention includes suitable means for self-aligning the vanes 30 to maintain a substantially uniform radial gap between the vanes and the liner 36 during travel thereof as the rotor 14 rotates.

More specifically, each vane 30 preferably includes a unitary or one-piece body 62 which is suitably sized and configured for being complementary with the corresponding rotor slot 28 in which it is mounted for radial reciprocation therein. As shown in FIGS. 1 and 2, the body 62 is configured as a generally rectangular flat planar plate slidingly engaging the cooperating rotor slot 28. Each vane 30 also includes an articulated vane tip 64 which is preferably a unitary or one-piece member pivotally joined to the radially outer end of the vane body 62 for providing self-alignment with the liner 36 as it rotates therealong.

Figure 3:
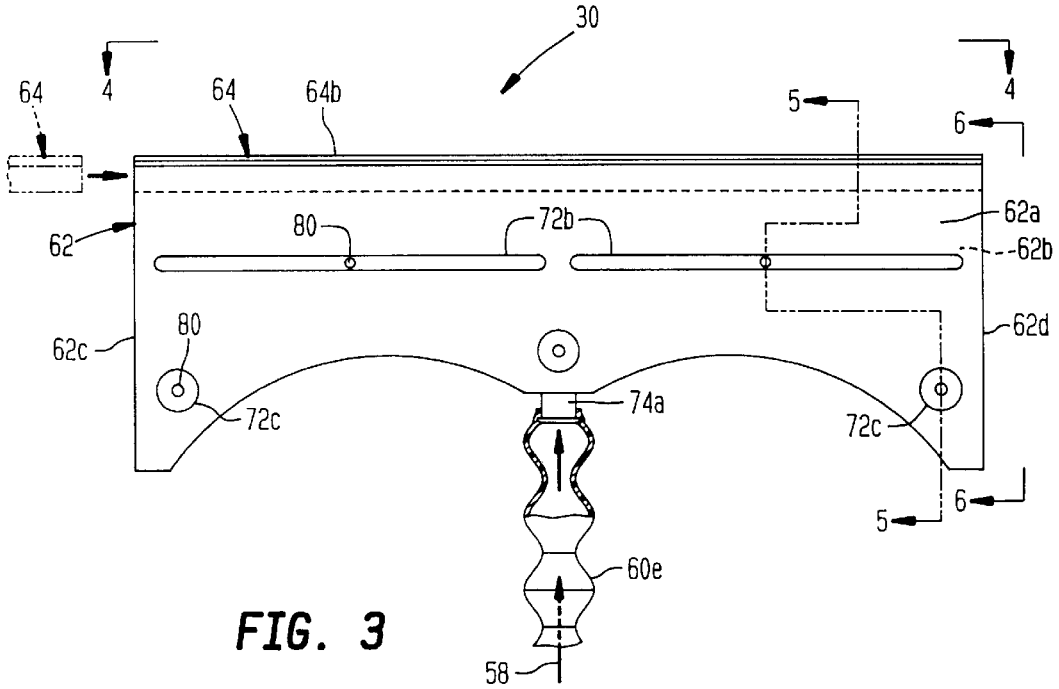
FIG. 3 is an isolated axial side view of the rotary vane illustrated in FIG. 2 including the integral self-aligning vane tip therein.
Figure 4:
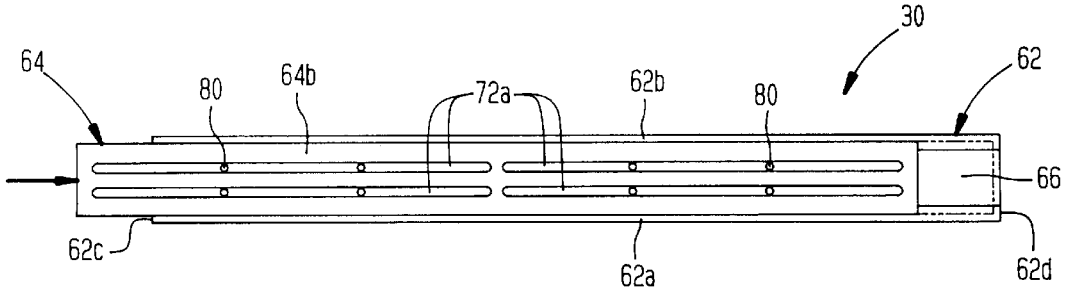
FIG. 4 is a top view of the vane illustrated in FIG. 3 and taken generally along line 4—4.
Figure 5:
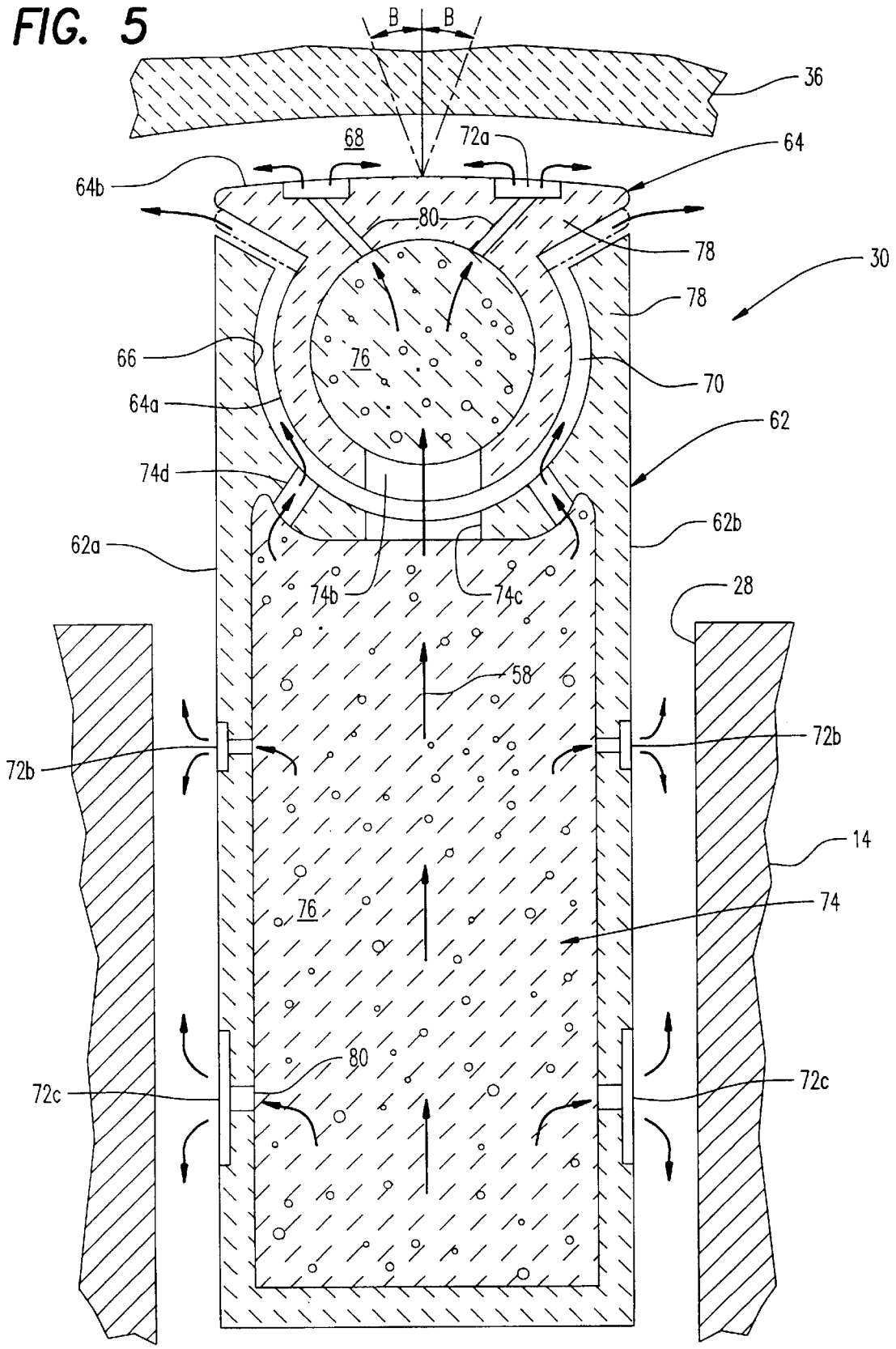
FIG. 5 is an enlarged radial sectional view through a portion of the vane illustrated in FIG. 3 and taken generally along jogging line 5—5 showing exaggerated clearances between the vane, tip, and cooperating rotor slot and casing.

FIGS. 3 and 4 show an isolated view of one of the vanes 30, with FIG. 5 being an enlarged radial sectional view therethrough having exaggerated clearances for illustrating certain features of the invention more clearly. As shown in FIG. 5, the body 62 includes a radially outwardly open, arcuate socket or cradle 66 which extends axially along the radially outer end thereof as illustrated also in FIG. 4. The vane tip 64 includes a generally cylindrical pin 64*a* and integral seal plate 64*b* extending along the pin 64*a* for facing the casing 36 to form a tip seal 68 therewith.

The pin 64*a* is complementary to the cradle 66 for defining a radial support gap 70 therebetween, and is radially outwardly trapped and retained by the cradle 66 coaxially therein for rocking movement which provides self-alignment of the seal plate 64*b* with the inner surface of the casing 36. The seal plate 64*b* is generally flat and preferably has a slight curvature matching the curvature of the liner and casing arcuate portions. In this way, the seal plate 64*b* provides an elongate or extended surface in the circumferential direction which is maintained generally parallel to the liner 36 during operation for providing a substantially uniform radial gap and tip seal 68 therebetween.

The vane tip 64 is preferably radially symmetrical so that centrifugal force self aligns the seal plate 64*b* substantially perpendicular to the inner surface of the liner 36 at all locations. The pin-and-cradle articulation of the tip 64 and the body 62 allow limited pivoting or rocking movement of the vane tip 64, as shown in phantom in FIG. 5, as it follows the oblong contour of the liner 36.

As indicated above with respect to FIG. 1, the vanes 30 are non-perpendicular to the flat portions of the liner 36 off-center from the 12 and 6o'clock positions. In the exemplary embodiment illustrated in FIG. 1, the vane bodies 62 deviate from perpendicular by a plus and minus tilt angle B of about +/−8.660° over the circumferential extent of the liner flat portions. Accordingly, the articulated vane tip 64 is free floating relative to the vane body 62 and remains parallel to the liner 36 even when the vane body 62 itself is non-perpendicular to the liner 36. The vane tip 64 will therefore rock in the cradle 66 to accommodate the tilt angle B relative to the vane body 62.

In order to pressurize the tip seal 68 and also effect an air bearing for supporting the vanes 30 under centrifugal force, each of the vane tips 64 includes a plurality of tip recesses 72*a* disposed in the tip plate 64*b* to face radially outwardly. The tip recesses 72*a* are disposed in flow communication with an internal fluid supply circuit 74 extending radially inwardly through the vane tip 64 and body 62 for discharging from the tip a pressurized fluid such as the air 58 received from the air pump 60. The vane fluid 58 exits the tip recesses 72*a* to pressurize the space between the liner 36 and the tip plate 64*b* to define the common tip seal and air bearing 68. The radial height of the tip seal 68 is self-setting during operation as the vane 30 rides on the cushion of air formed thereby during operation, and may be about a half mil for example.

Although the vane body 62 becomes non-perpendicular the flat portions of the casing 20 as described above, the vane tip 64 is allowed to articulate relative to the body 62 for always maintaining the tip plate 64*b* substantially parallel to the casing and liner for maintaining a substantially uniform tip seal 68 therebetween. The tip seal 68 effectively confines both the working fluid 40 and the combustion gases 44 in their respective flow chambers. And, the articulated vane tip 64 ensures maximum air bearing support of the entire vane 30 on an effective cushion of air along the liner 36.

Since the vane tip 64 rocks during operation in the cradle 66, it is desirable to provide a suitable bearing therebetween for reducing friction during operation. Accordingly, the pin gap 70 illustrated in FIG. 5 is preferably disposed in flow communication with the supply circuit 74 for channeling a portion of the vane fluid 58 through the pin gap 70 and between the pin 64*a* and cradle 66 for effecting another fluid or air bearing therebetween. In this configuration, the fluid pressurized pin gap 70 defines a corresponding second air bearing also designated 70. In this way, a generally frictionless bearing is provided between the vane tip 64 and body 62 for allowing rocking of the tip 64 without undue wear during operation.

Referring again to FIG. 5, the pin 64*a* and cradle 66 preferably extend together greater than 180° to radially self-capture or trap the pin 64*a* in the cradle 66 while allowing the limited rocking movement therebetween. In this way, the tip 64 is self-retained to the body 62 and cannot fall out of the cradle 66 radially which would be a concern during assembly, or when the rotor 14 is stationary.

The pin 64*a* is preferably cylindrical where it cooperates with the correspondingly cylindrical cradle 66, and joins the tip plate 64*b* for substantially increasing the effective surface area of the tip 64 available to define the tip seal 68. Accordingly, the tip plate 64*b* preferably extends coextensively with the radially outer end of the vane body 62 from front-to-back circumferentially and from side-to-side axially as illustrated in FIGS. 4 and 5. The tip plate 64*b* therefore covers the full perimeter projection of the vane body 62 to define the tip seal 68 with the liner 36 during operation.

As shown in FIGS. 3 and 4, the vane tip 64, including the pin 64*b* and cooperating cradle 66, preferably extends completely axially through the vane body 62. In this way, the vane tip 64 may be readily assembled to the vane body 62 by simply initially inserting the vane tip 64 axially in the cradle 66 during assembly. This is illustrated in phantom in FIG. 3 and in solid line in FIG. 4 wherein the vane tip 64 is axially slid along the cradle 66 until its two opposite ends are aligned with the opposite sides of the vane body 62.

As shown in FIGS. 3 and 4, the vane body 62 preferably includes opposite front and back flat radial faces 62*a,b* and a pair of opposite flat radial sides 62*c,d*. As shown in FIG. 5, the faces 62*a,b* face corresponding portions of the rotor 14 in the rotor slot 28. As shown in FIG. 2, the vane sides 62*c,d* face the liner 36 along corresponding sidewalls 22, 24 adjoining the casing 20.

Figure 6:
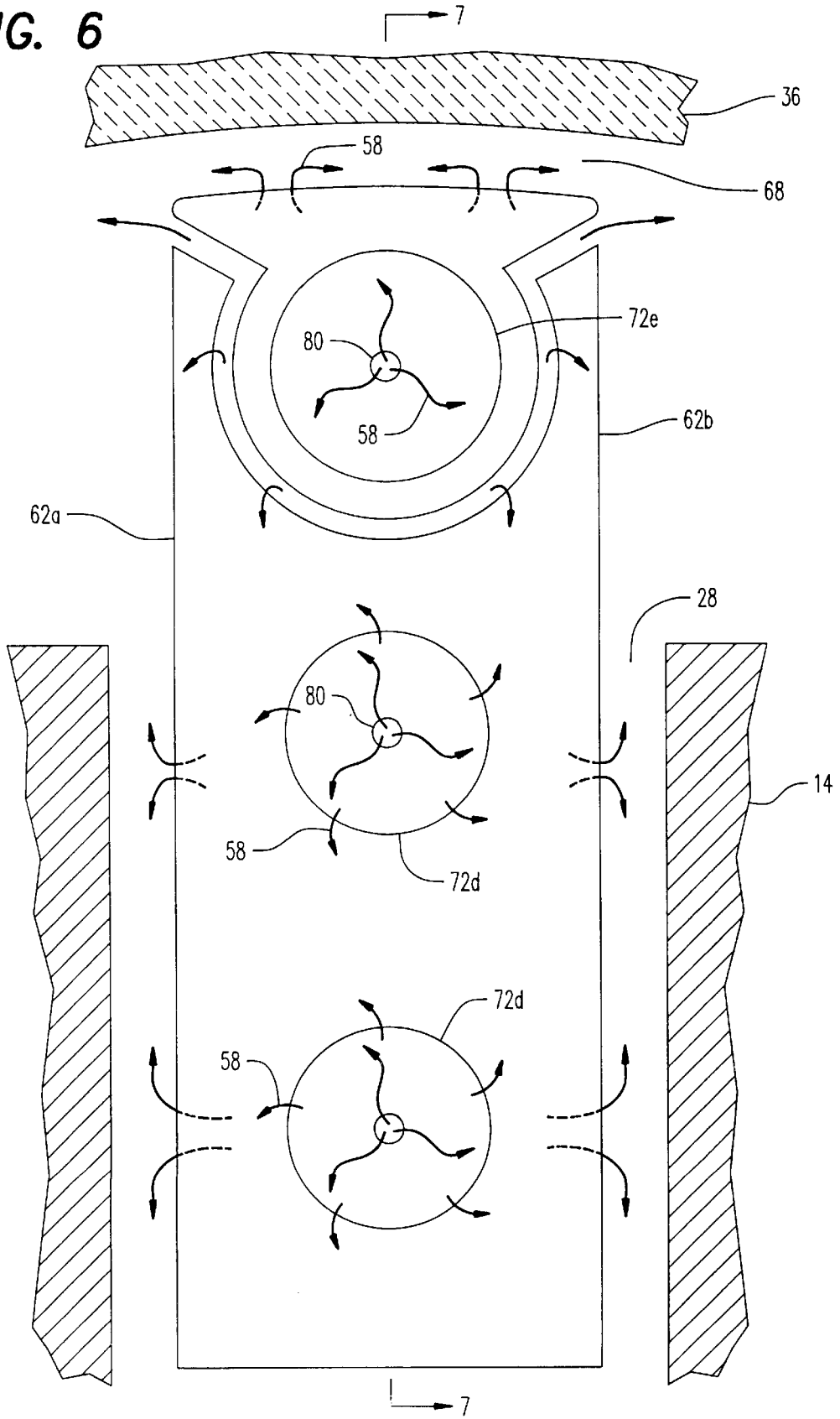
FIG. 6 is an enlarged radial end view of the vane illustrated in FIG. 3 and taken generally along line 6—6.

As shown in FIGS. 3, 5, and 6, the faces and sides 62*a–d* include a plurality of external lateral recesses 72*b,c,d* disposed in flow communication with the fluid supply circuit 74 for discharging the vane fluid 58 to form corresponding lateral seals and air bearings with the rotor 14 and sidewalls 22, 24.

Similarly, the opposite axial ends of the vane tip 64 include lateral recesses 72*e* in counterbore form for discharging the vane fluid 58 therefrom to provide an air bearing and sealing surface with the adjacent liner 36.

As illustrated in FIG. 4, the tip recesses 72*a* are preferably configured in the form of a plurality of elongate slots extending axially along the tip plate 64*b*. Individual and separated slots 72*a* are preferred for maximizing the effectiveness of the air discharged therefrom.

As shown in FIG. 3, some of the lateral recesses, e.g. 72*b*, are preferably configured in the form of a plurality of elongate slots also extending axially along the vane faces 62*a,b*. FIG. 3 also illustrates that some of the lateral recesses, 72*c*, may be configured in the form of a plurality of circular counterbores in the vane faces 62*a,b*. Since the bottom portion of the exemplary vane 30 illustrated in FIG. 3 is configured with a pair of generally semi-circular profiles to accommodate the counter-balancing beams 52, the counterbore recesses 72*c* may be preferentially positioned in non-uniform portions of the faces 62*a,b* to maximize the air bearing effectiveness of the air discharged therefrom. Since the faces 62*a,b* extend uniformly axially over the upper part of the vane body, the slot recesses 72*b* are preferred in this region for uniformly distributing the pressurized air.

The lateral recesses 72*d* in the vane sides 62*c,d*, as illustrated in FIG. 6 for example, are preferably configured in the form of a plurality of circular counterbores suitably positioned for use in the distributing the pressurized air therefrom.

Figure 7:
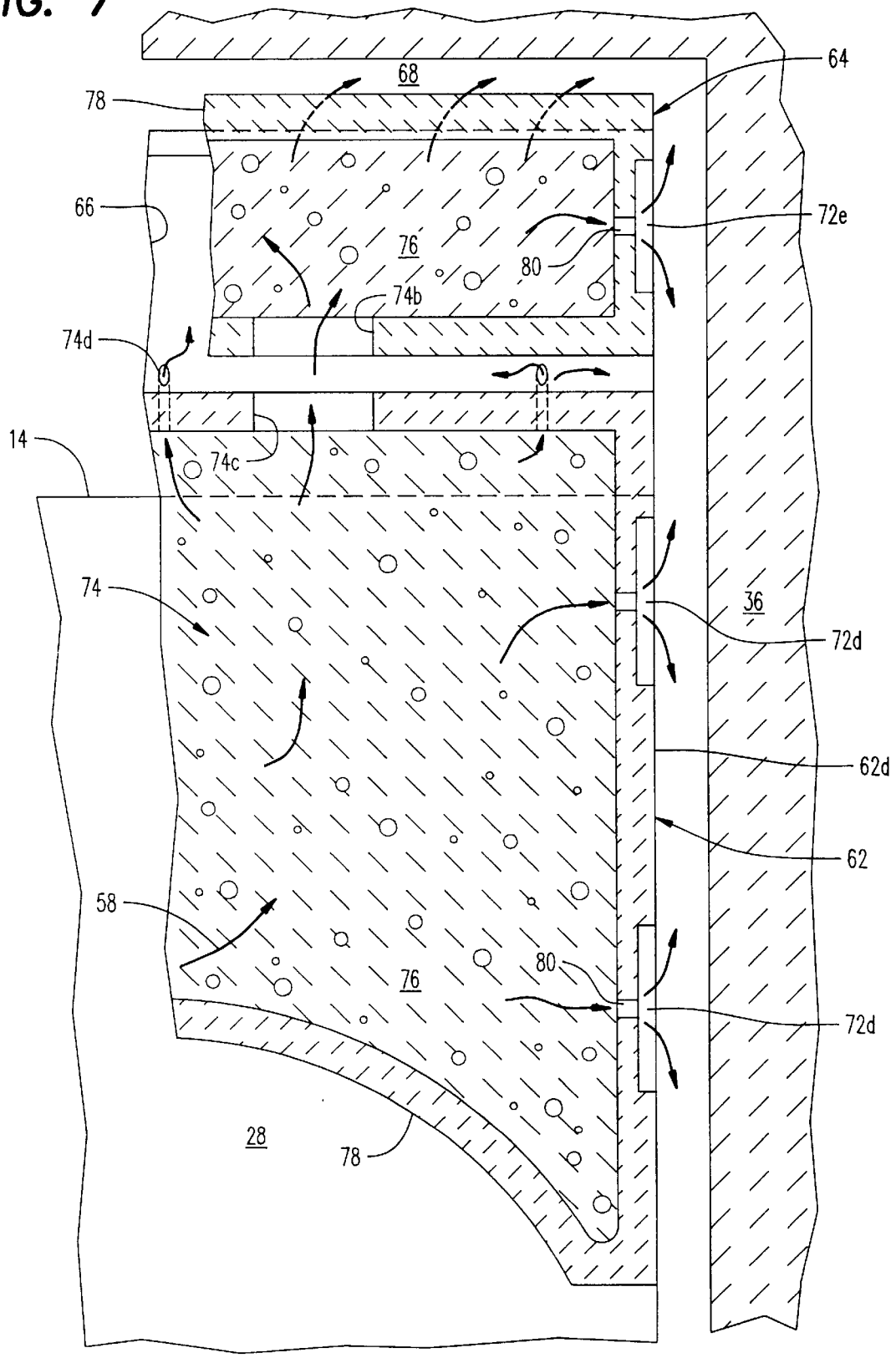
FIG. 7 is an enlarged axial sectional view of a side portion of the vane illustrated in FIG. 6 and taken generally along line 7—7.

As indicated above, in order to reduce weight yet provide suitable strength, the vane body 62 and tip 64 each comprise a porous, open-cell ceramic core 78 surrounding by an integral non-porous ceramic skin or shell 76 as illustrated in FIGS. 5 and 7. In this way, the fluid supply circuit 74 may be defined in part by the cores 76 of the vane tip 64 and body 62 since the open-cell foam structure allows the vane fluid 58 to flow therethrough to at least the tip recesses 72*a* for discharge therefrom.

The shell 78 is preferably thin for maximizing weight reduction, yet at the same time provides the primary strength of the vane 30 in the exemplary fiber reinforced ceramic matrix described above. The matrix may include, for example, solid silicon carbide or nitride with reinforcing fibers such as carbon or silicon carbide. The open-cell core 76 may have about one tenth the mass density of the solid shell 78 for reducing vane weight, and corresponding centrifugal forces generated thereby.

The shell 78 has a suitable thickness for providing the primary strength of the vane 30 and may be about 15 to about 30 mils thick, for example. The various discharge recesses 72*a–e* are preferably shallow in depth and extend only in part into the shells 78 for laterally distributing the vane fluid 58 without compromising the strength of the shells 78. For example, the recess depth may be about 5 mils into the outer surface of the shell 78.

Since the shell 78 is preferably non-porous, the supply circuit 74 further includes a plurality of feed holes 80 extending through the shells 78 in flow communication between the cores 76 and the various tip and lateral recesses 72*a–e* as illustrated in FIGS. 5 and 7 for example. The feed holes 80 are substantially smaller than size or diameter than the corresponding recesses 72*a–e* for maintaining the strength of the shells 78, and may be about 10 to about 15 mils in diameter. The slot recesses 72*a,b* illustrated in FIGS. 3 and 4 may have any suitable width and length for distributing the vane fluid 58. Similarly, the circular recesses 72*c,d,e* may have any suitable diameter for distributing the vane fluid 58, and for example may be about 250 mils in diameter.

As illustrated in FIG. 3, the supply circuit 74 further includes a body inlet 74*a* at a radially inner end of the vane body 62 joined by the bellows 60*c* to the air pump 60 as described above. The inlet 74*a* extends through the shell 78 for channeling the vane fluid 58 into the core 76 of the vane body 62. The vane fluid 58 then flows radially outwardly and laterally through the body core 76 for discharge from the several lateral recesses 72*b–d*.

In order to supply a portion of the vane fluid 58 to the vane tips 64, the supply circuit 74 further includes a plurality of tip inlets 74*b* disposed in the bottom of the tip pin 64*a* as illustrated in FIG. 5 at the pin gap 70, which extend through the tip shell 78 to the tip core 76. A corresponding plurality of vane body outlets 74*c* are disposed at the bottom of the cradle 66 at the pin gap 70 and extend through the body shell 78 into the body core 76. The body outlets 74*c* are preferably radially aligned with respective ones of the tip inlets 74*b* for channeling the vane fluid 58 therethrough and radially across the pin gap 70. The inlets and outlets 74*b,c* are suitably axially spaced apart in pairs along the axial extent of the vane 30, and have a suitably large diameter for carrying an effective portion of the vane fluid 58 through the vane tip 64 and out the tip recesses 72*a* for effecting the tip seal 68 during operation.

Although a portion of the fluid 58 feeding the body outlet 74*c* may flow laterally through the pin gap 70, a plurality of purge holes 74*d* are separately disposed in the cradle 66 through the body shell 78 to its core 76 for channeling a portion of the vane fluid 58 from the supply circuit 74 into the pin gap 70. The purge holes 74*d* are preferably circumferentially spaced apart from the body outlets 74*c* and are axially spaced apart from each other along the length of the cradle 66 to suitably supply the entire pin gap 70 with the vane fluid 58. In this way, a suitable, effectively frictionless fluid bearing is defined by the pin gap 70 between the vane body 62 and tip 64. Furthermore, the vane fluid 58 is discharged from the pin gap 70 along the edges of the tip plate 64*b* for ensuring spatial separation between the tip and body while providing effective cooling thereof.

As described above, by providing a relatively simple, unitary vane tip 64 in the correspondingly simple unitary vane body 62, the tip plate 64*b* may enjoy self-alignment with the casing and liner therein as it rotates around the oblong surface thereof. The vane tip 64 is allowed to rock back and forth to accommodate the non-perpendicular orientation of the vane body 62 at the off-center regions of the casing flat portions. The tip seal 68 and air bearing provided thereby maintain maximum performance around the entire circumference of the casing 20 and provide effectively frictionless operation of the vanes 30 against the casing 20. The vane tips 64 themselves are selfsupported by the bearing defined by the pressurized pin gap 70 additionally providing effectively frictionless operation, at the same time providing effective cooling thereof by the independent vane fluid 58. Since the vanes 30 are freely mounted in the rotor 14 for unrestrained radial reciprocation, the counterbalancing means illustrated in FIG. 2 decrease the effective centrifugal force which must be carried to the casing 28 by the tip seal 68.

The vanes 30 are effectively counterbalanced during operation for reducing vane-to-casing bearing loads while maintaining effective seals at the vane tips. By using suitable ceramics for the liner and the vane tips, and providing air bearings therebetween, the need for petroleum based lubrication oils is eliminated. And, providing the self-aligning vane tips further reduces friction and wear while maintaining an effective seal thereat for obtaining improved efficiency of the machine 10 with an enhanced useful lifetime. The airflow through the vanes also provides cooling of the vanes during operation. This is particularly useful for the engine embodiment illustrated, as well as for the compressor or pump embodiments.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims:

I claim:

1. A vane for a rotary machine having a rotor and a slot therein disposed in a stator casing, said vane comprising:

a body being complementary with said rotor for radial reciprocation therein, and including an arcuate cradle extending axially along a radially outer end thereof;

a tip including a pin and an integral plate extending along said pin for facing said casing to form a tip seal therewith, said pin being complementary to said cradle for defining a radial pin gap therebetween, and being radially outwardly retained by said cradle coaxially therein for rocking movement; and said vane body and vane tip each comprising a porous, open-cell core surrounded by an integral non-porous shell.

2. A vane according to claim 1 further comprising a plurality of tip recesses disposed in said tip plate, and disposed in flow communication with a fluid supply circuit extending through said vane tip and body, for discharging a pressurized vane fluid to form a tip seal between said tip plate and said casing.

3. A vane according to claim 2 wherein said pin gap is disposed in flow communication with said supply circuit for channeling a portion of said vane fluid through said gap and between said pin and cradle for effecting a fluid bearing therebetween.

4. A vane according to claim 3 wherein said pin and cradle extend together greater than 180° to radially capture said pin in said cradle while allowing limited rocking therebetween.

5. A vane according to claim 4 wherein said pin and cradle extend completely axially through said vane body.

6. A vane according to claim 5 wherein said tip plate is coextensive with said radially outer end of said vane body.

7. A vane according to claim 3 wherein:

said vane body includes opposite front and back faces to face said rotor in said rotor slot, and a pair of opposite sides to face corresponding side walls adjoining said casing; and said faces and sides include a plurality of lateral recesses disposed in flow communication with said supply circuit for discharging said vane fluid to form lateral seals with said rotor and said sidewalls.

8. A vane according to claim 7 wherein:

said tip recesses are configured as a plurality of elongate slots extending axially along said tip plate; and said lateral recesses are configured as a plurality of elongate slots extending axially along said vane faces.

9. A vane according to claim 7 wherein said lateral recesses are configured as a plurality of circular counterbores in said vane faces and sides.

10. A vane according to claim 3 wherein said fluid supply circuit is defined in part by said cores of said vane body and tip disposed in flow communication with said tip recesses.

11. A vane according to claim 10 wherein said fluid supply circuit further comprises a plurality of feed holes extending through said shell in flow communication between said core and said tip recesses.

12. A vane according to claim 11 wherein said fluid supply circuit further comprises a body inlet at a radially inner end of said vane body.

13. A vane according to claim 11 wherein said vane body includes a plurality of lateral recesses disposed in flow communication with said supply circuit by additional ones of said feed holes through said shell.

14. A vane according to claim 13 wherein said tip and lateral recesses are shallow and extend only in part into said shells.

15. A vane according to claim 3 wherein said fluid supply circuit comprises:

a plurality of tip inlets disposed in said tip pin at said pin gap; and a plurality of body outlets disposed in said cradle at said pin gap, and aligned with respective ones of said tip inlets for channeling said vane fluid therethrough across said pin gap.

16. A vane according to claim 3 further comprising a plurality of purge holes disposed in said cradle in flow communication with said fluid supply circuit for channeling said vane fluid through said pin gap to effect said fluid bearing between said body and tip.

17. A vane according to claim 3 in combination with said rotary machine, with said vane body being slidingly received in said rotor slot for radial reciprocating movement therein while maintaining said vane tip adjacent to said casing, with said tip seal therebetween being also effective as a fluid bearing to support said vane under centrifugal force.

18. A rotary machine 11 according to claim 17 further comprising means disposed in flow communication with said fluid supply circuit for providing said vane fluid thereto.

19. A rotary machine 11 according to claim 18 wherein:

said casing is oblong to define with said rotor a first chamber for moving a working fluid;

said rotor includes a plurality of said rotor slots circumferentially spaced apart from each other, and each slot including a respective one of said vanes, with said vane tips being rockable in said cradles for maintaining said tip plates substantially parallel to said oblong casing as said rotor rotates said vanes therealong;

said vane body and vane tip each comprise a porous, open-cell core surrounded by an integral non-porous shell; and said fluid supply circuit is defined in part by said cores of said vane body and tip disposed in flow communication with said tip recesses.

20. A rotary machine according to claim 19 wherein said fluid supply circuit further comprises:

a plurality of tip inlets disposed in said tip pin at said pin gap; and a plurality of body outlets disposed in said cradle at said pin gap, and aligned with respective ones of said tip inlets for channeling said fluid therethrough across said pin gap; and further comprising:

a plurality of purge holes disposed in said cradle in flow communication with said fluid supply circuit for channeling said fluid through said pin gap to effect said fluid bearing between said body and tip.

21. A rotary machine according to claim 19 wherein said vane fluid providing means are disposed in flow communication with said first working chamber for bleeding a portion of said working fluid therefrom as said vane fluid.

22. A rotary machine according to claim 21 in the form of an internal combustion engine further comprising:

a second chamber disposed in said casing oppositely to said first chamber, with said first chamber defining a compression zone for compressing said air, and said second chamber defining a combustion zone;

a flow chamber disposed in flow communication with both said first and second chambers for channeling said compressed air from said first chamber to said second chamber as said rotor rotates;

means for injecting fuel into said compressed air in said flow chamber to form a fuel and air mixture; and means for igniting said fuel and air mixture in said second chamber.

* * * * *